US007152387B2

(12) United States Patent
Taylor

(10) Patent No.: US 7,152,387 B2
(45) Date of Patent: Dec. 26, 2006

(54) PACKAGING MACHINE AND FORMER

(75) Inventor: Alfred Alexander Taylor, Lugarno (AU)

(73) Assignee: TNA Australia Pty Limited, Lidcombe (AU)

( * ) Notice: Subject to any disclaimer, the term of this patent is extended or adjusted under 35 U.S.C. 154(b) by 43 days.

(21) Appl. No.: 11/029,528

(22) Filed: Jan. 4, 2005

(65) Prior Publication Data

US 2005/0172582 A1 Aug. 11, 2005

(30) Foreign Application Priority Data

Jan. 6, 2004 (AU) ..... 2004900047

(51) Int. Cl.
*B65B 31/00* (2006.01)
*B65B 9/22* (2006.01)

(52) U.S. Cl. ..... 53/511; 53/551; 493/302

(58) Field of Classification Search ..... 53/432–434, 53/510–512, 450, 451, 545–555; 493/302
See application file for complete search history.

(56) References Cited

U.S. PATENT DOCUMENTS

| | | | | |
|---|---|---|---|---|
| 2,145,941 A | | 2/1939 | Maxfield | |
| 3,042,103 A | * | 7/1962 | McDevitt et al. | 493/302 |
| 3,528,214 A | * | 9/1970 | Calvano | 53/511 |
| 3,534,523 A | * | 10/1970 | Davidson et al. | 53/505 |
| 3,681,892 A | * | 8/1972 | Safranski | 53/551 |
| 3,789,888 A | * | 2/1974 | James et al. | 53/433 |
| 4,350,002 A | * | 9/1982 | Focke | 53/449 |
| 4,640,083 A | * | 2/1987 | Takahashi et al. | 53/551 |
| 4,738,287 A | * | 4/1988 | Klinkel | 53/511 |
| 4,769,974 A | * | 9/1988 | Davis | 53/433 |
| 4,964,259 A | * | 10/1990 | Ylvisaker et al. | 53/433 |
| 5,581,984 A | * | 12/1996 | Domke et al. | 53/552 |
| 6,131,367 A | * | 10/2000 | Fukuda et al. | 53/551 |
| 6,220,000 B1 | * | 4/2001 | Kammler et al. | 53/511 |
| 6,619,018 B1 | * | 9/2003 | Sasaki | 53/511 |
| 6,735,928 B1 | * | 5/2004 | Kondo et al. | 53/433 |
| 6,929,151 B1 | * | 8/2005 | Clayton | 222/79 |

FOREIGN PATENT DOCUMENTS

| | | |
|---|---|---|
| EP | 1077176 A1 | 2/2001 |
| FR | 2819235 A1 | 7/2002 |
| GB | 930528 | 7/1963 |

* cited by examiner

*Primary Examiner*—Stephen F. Gerrity
(74) *Attorney, Agent, or Firm*—Townsend and Townsend and Crew LLP

(57) ABSTRACT

A packaging machine former (10) having a base (11) upon which there is mounted a former member (12). Strip bag material passes over the member (12) to be arranged from a strip configuration to a tubular configuration into which product to be packaged is delivered. The base (11) and member (12) have passages through which a gas is delivered to be included with the product in the bags being formed.

8 Claims, 5 Drawing Sheets

PACKAGING MACHINE AND FORMER

TECHNICAL FIELD

The present invention relates to packaging machines and their associated formers, and more particularly but not exclusively to vertical form fill and seal packaging machines and their formers.

BACKGROUND OF THE INVENTION

Packaging machines such as those described in U.S. Pat. No. 4,753,336 receive tubular bag material into which product is delivered. The machine transversely seals and cuts the tubular bag material to form discreet bags.

The above-mentioned tubular bag material is provided by a former. The former receives bag material in strip form and reconfigures it into a tubular configuration.

The size of the tubular bag material is determined by the former. More particularly, bags of a required size are produced with the user of a former designed to produce tubular bag material to suit that particular size bag.

Factories often produce a variety of products, with each of the products frequently being contained in different size bags. Accordingly formers need to be regularly changed to suit different products and different bag sizes.

To prolong the life of some packaged products it is necessary to reduce the amount of oxygen within the bag. This is usually achieved by delivering nitrogen to the former and having the nitrogen contained in the bags. To deliver the nitrogen to the former there is provided a separate gas supply line.

The above-discussed construction of formers suffers a number of disadvantages in that it is difficult and time-consuming to replace the formers and their associated gas lines. During replacement of a former the associated packaging machine is unusable. Accordingly there is a piece of expensive apparatus that is lying idle.

OBJECT OF THE INVENTION

It is an object of the present invention to overcome or substantially ameliorate at least one of the above disadvantages.

SUMMARY OF THE INVENTION

There is disclosed herein a packaging machine former to engage an upwardly projecting locating spigot of a packaging machine, the spigot including a gas outlet, the former including:

a base having a socket to receive the spigot so that the former is located thereby with respect to the machine;

a former member over which strip bag material passes to be configured into tubular bag material, the former member providing a generally vertically oriented product passage into which product is deposited for delivery into the tubular bag material; and wherein said base and member provide gas passages that communicate with the socket so as to receive a gas from said spigot and deliver the gas to said product passage.

Preferably the former has a former shoulder, and the gas passages extend to the shoulder so as to deliver the gas to the product passage.

Preferably the former includes a backing member extending downwardly from the base, and the gas passages extend through the backing member to deliver the gas to the interior of the tubular bag material.

Preferably the former is configured to engage a packaging machine having a pair of upwardly extending locating spigots, each spigot providing a gas outlet, and wherein the socket is a first socket, and the base has a second socket, with the sockets being positioned to each respectively receive a respective one of the spigots so as to receive gas therefrom, with the gas passages communicating with each socket.

There is further disclosed herein a packaging machine including a mounting upon which a packaging former is to rest so as to be supported thereby, and wherein the mounting includes an upwardly extending spigot to be received by the former to locate the former with respect to the machine, the spigot including a gas passage to which a gas is delivered to the former, and a moveable valve member operatively associated with the passage so as to be moveable between a first position closing the passage, and a second position permitting gas to pass through the passage, the moveable valve member being urged to the first position and moved to the second position upon engagement with the former.

In a particular preferred form the above-mentioned packaging machine former is used in combination with the above-mentioned packaging machine.

BRIEF DESCRIPTION OF THE DRAWINGS

A preferred form of the present invention will now be described by way of example with references to the accompanying drawings.

DETAILED DESCRIPTION OF THE PREFERRED EMBODIMENT

Figure 1:
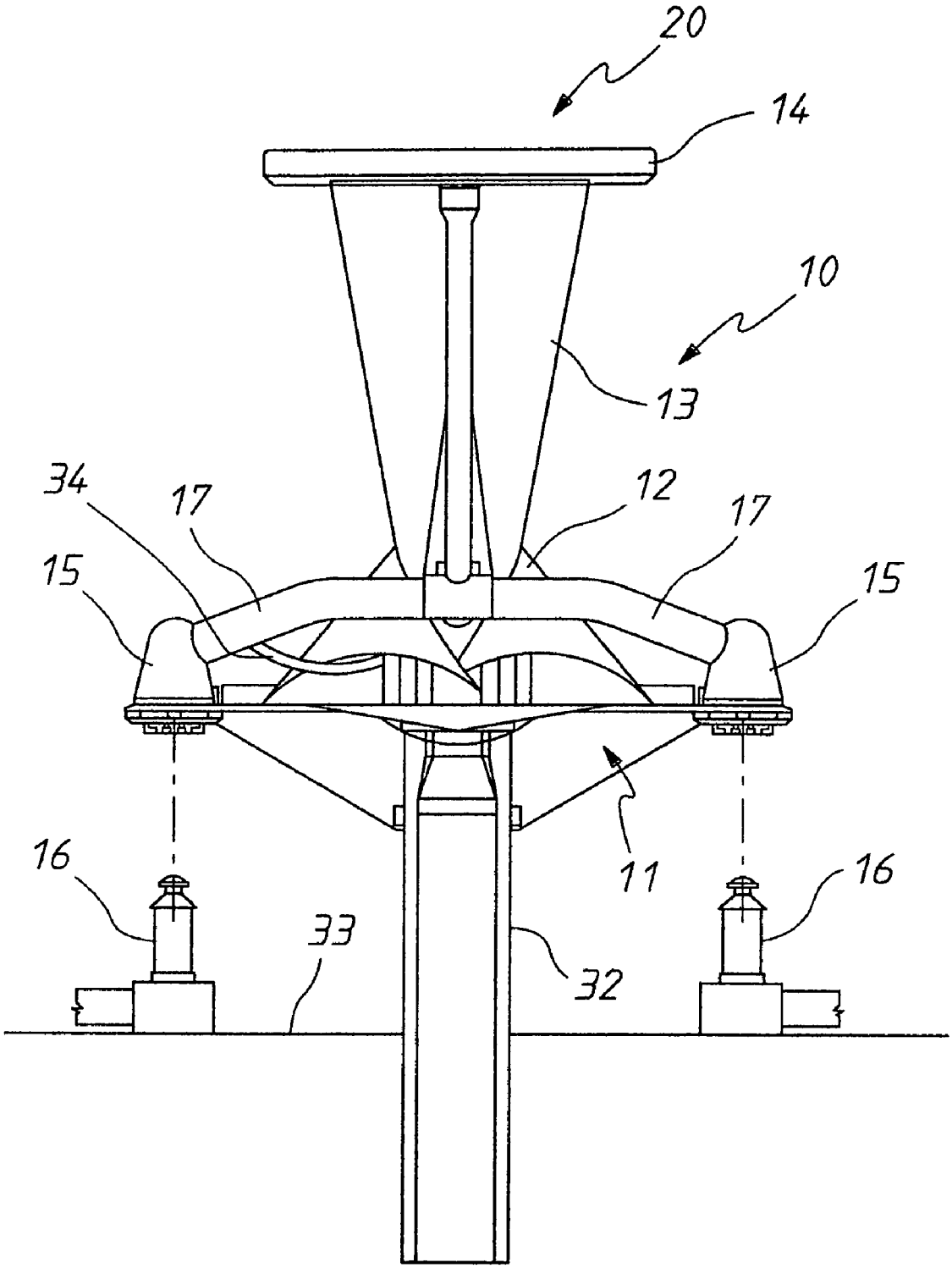
FIG. 1 is a schematic front elevation of a packaging machine former and portion of a packaging machine.
Figure 2:
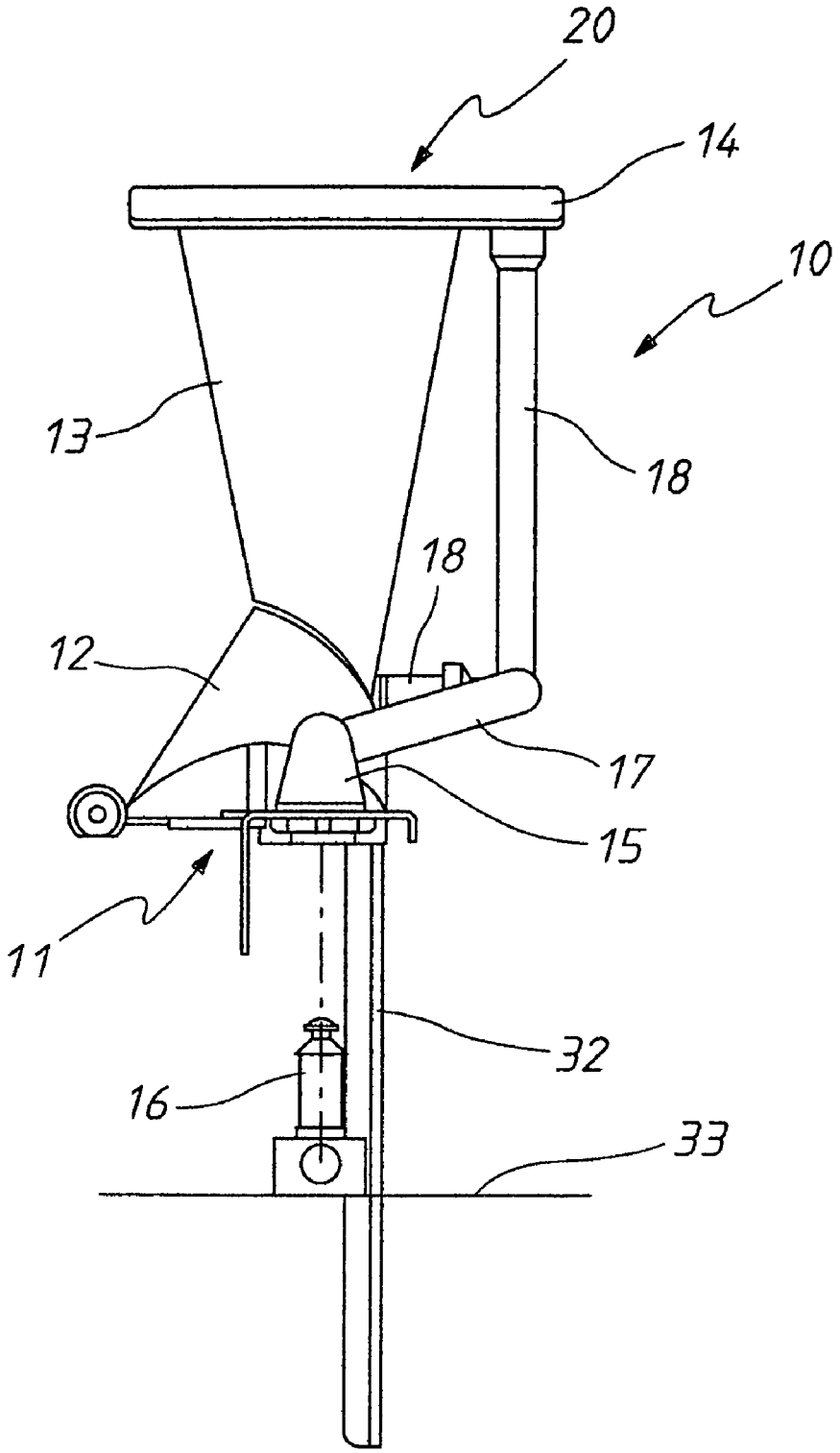
FIG. 2 is a schematic side elevation of the former and packaging machine of FIG. 1.
Figure 3:
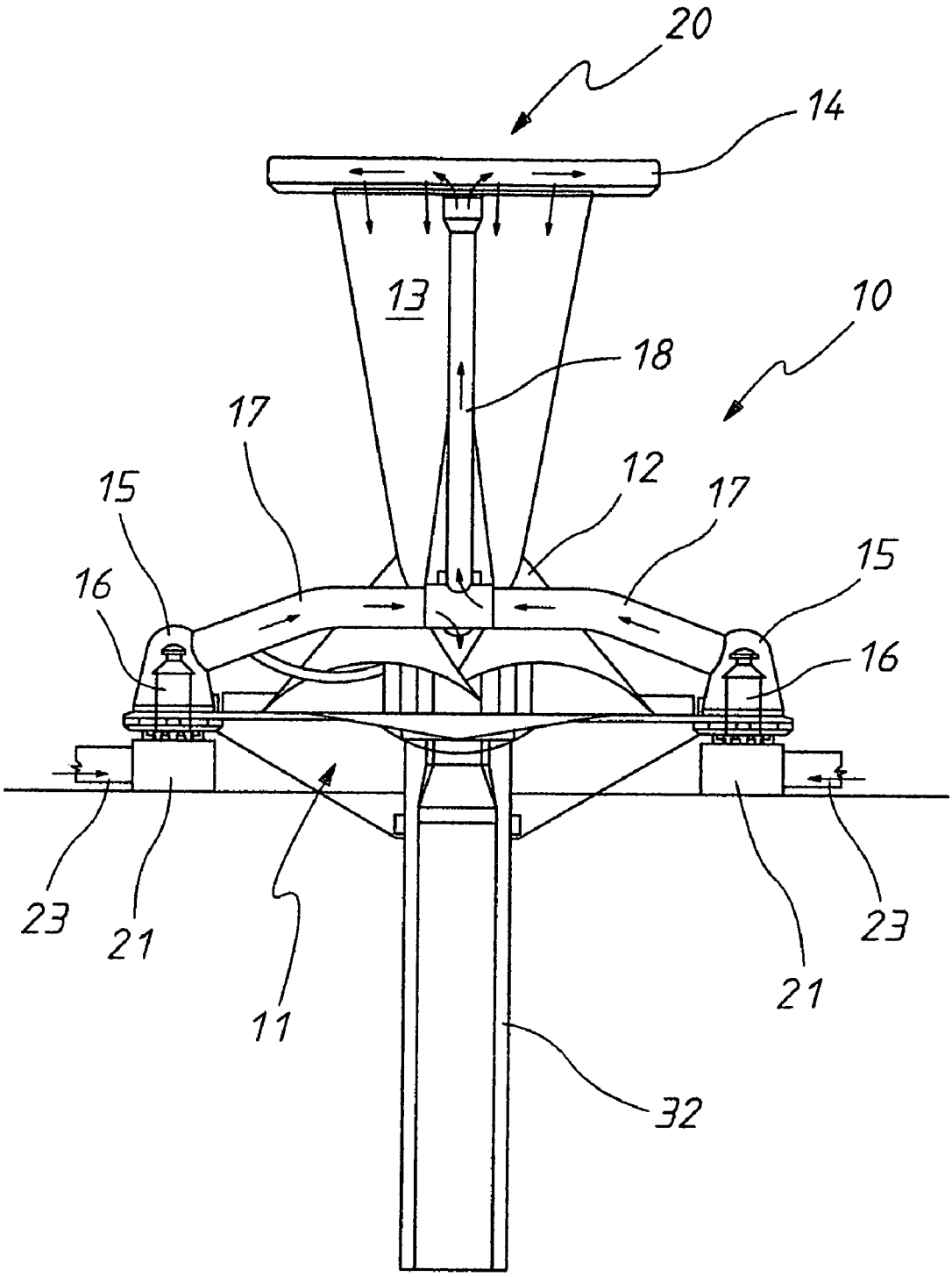
FIG. 3 is a schematic front elevation of the former of FIG. 1 mounted on the packaging machine of FIG. 1.
Figure 4:
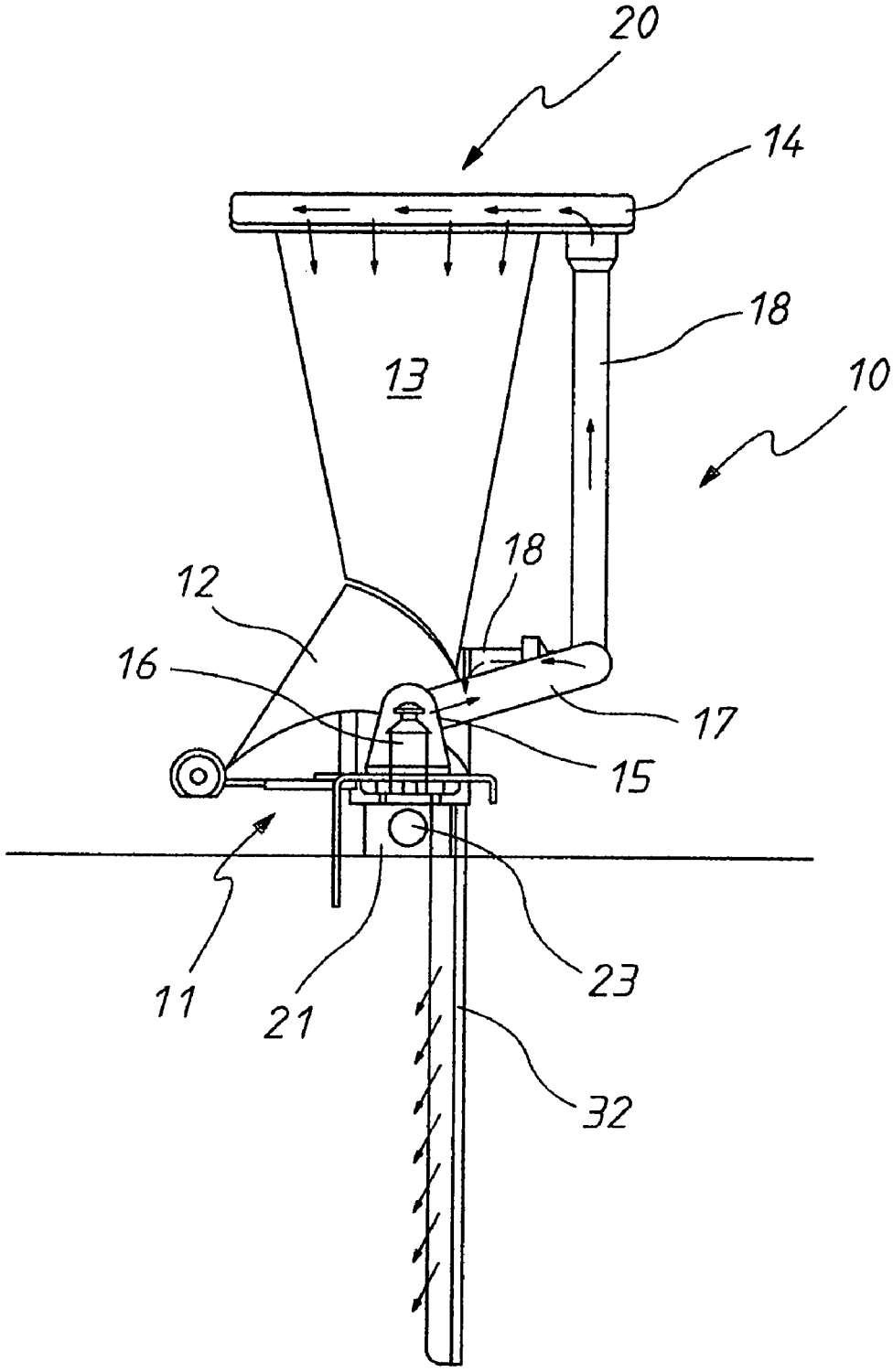
FIG. 4 is a schematic side elevation of the former and packaging machine of FIG. 3.

In the accompanying drawings there is schematically depicted a packaging machine former 10. The former 10 includes a base 11 upon which there is mounted a former member 12 to which strip bag material is delivered to be configured into tubular bag material. Extending upwardly from the upper portions of the former member 12 is a chute 13 terminating at its upper edge with a hollow rim 14.

Attached to and extending downwardly from the base 11 is a backing member 32 against which the tubular bag material would pass so that overlapping longitudinal edge portions of the bag material can be engaged by a heater to form a longitudinal seal in the tubular bag material. Typically, the heater is a bar which slides/drags over the bag material.

The base 11 includes a pair of sockets 15 that are positioned to engage upwardly projecting spigots 16 of the packaging machine 33. The spigots 16 are gas outlets and deliver gas to the former 10.

Extending from sockets 15 are tubes 17 that communicate with further tubes 18 to distribute a gas such as nitrogen to various internal portions of the vertical passage 20 of the former 10. More particularly product is delivered to the passage 20 to be located internally of the tubular bag material. A tube 34 extends from the tube 17 to an air bleed fitting located on former member 12. This tube 34 can be used to provide an air bearing between the former member 12 and the bag material to reduce friction therebetween.

The tube 18 communicates with the rim 14 so as to deliver gas thereto. The rim 14 is provided with a single annular aperture or a plurality of apertures so that the nitrogen is delivered to the upper end of the passage 20. The lower tube 18 communicates with the lower end of the chute 13 again to deliver nitrogen thereto.

Internally of the base 11 is a passage that communicates with an internal passage of the backing member 32 again to deliver nitrogen to a position internally of the tubular bag material. Accordingly the tubes 17 and 18, rim 14 and backing member 32 provide passages via which a gas such as nitrogen is mixed with the product and contained in the tubular bag material to minimize the amount of oxygen in the bags produced.

Each socket 15 includes a cavity 19 that receives an associated one of the spigots 16. Each spigot 16 includes a base 21 having an internal passage 22 that communicates with a tube 23 via which nitrogen is delivered to the spigots 16. Attached to and extending upwardly from the base 21 is a hollow generally cylindrical projection 24 providing a generally upwardly extending passage 25.

Figure 5:
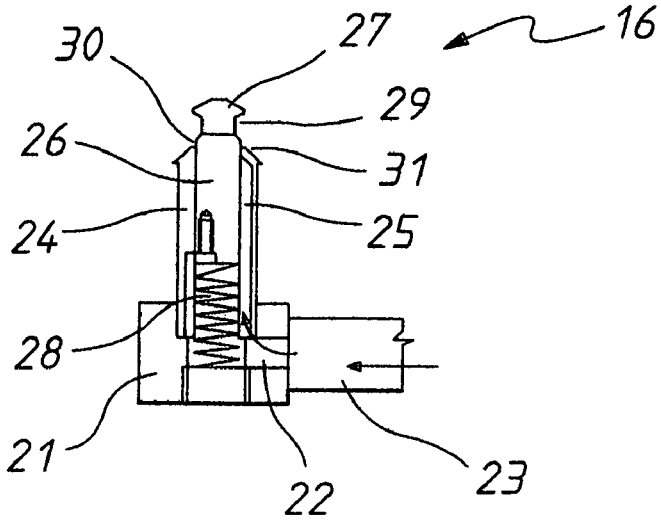
FIG. 5 is a schematic sectioned front elevation of a mounting spigot of the packaging machine of FIG. 1.

Slidably mounted in the projection 24 is a moveable valve member 26 having a head 27 located above the projection 24. The moveable valve member 26 is urged by means of a spring 28 to its uppermost position as illustrated in FIG. 5.

Figure 6:
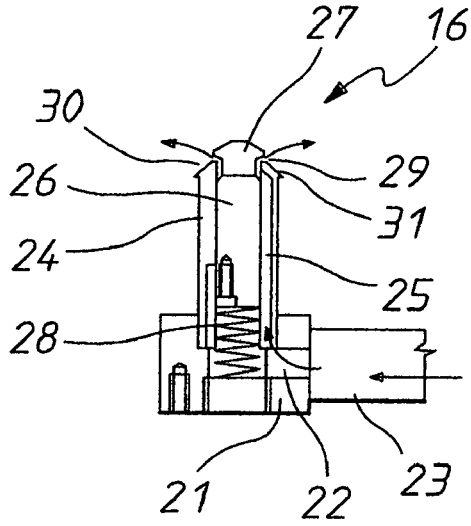
FIG. 6 is a further schematic side elevation of the mounting spigot of FIG. 5.
Figure 7:
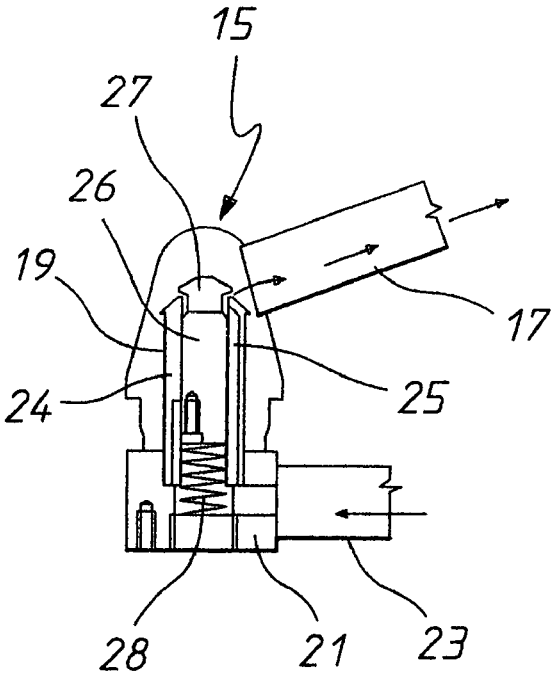
FIG. 7 is a schematic sectioned elevation of the spigot of FIGS. 5 and 6 with a portion of the former mounted thereon.

The head 27 provides an annular recess 29 that cooperates with the passage 25 to release the nitrogen. The annular recess 29 is positioned as shown in FIG. 6 allowing the escape of the nitrogen by engagement of the head 27 with the upper surface of the cavity 19.

The projection 24 has an upper aperture 30 through which the moveable valve member 26 projects. The aperture 30 is provided by an annular flange 31 that is abutted by the moveable valve member 26 when the valve member 26 is in its uppermost position to be thereby captively located by the annular flange 31.

The above-described preferred embodiment facilitates quick removal and mounting of the former 10 on the packaging machine 33 while providing for automatic gas connection. In particular by having the sockets 15 engage spigots 16 correct alignment of the former 10 with respect to the packaging machine 33 is assured.

The invention claimed is:

1. A packaging machine former to engage an upwardly projecting locating spigot of a packaging machine, the spigot including a gas outlet, the former including:

a base having a socket to receive the spigot so that the former is located thereby with respect to the machine;

a former member over which strip bag material passes to be configured into tubular bag material, the former member providing a generally vertically oriented product passage into which product is deposited for delivery into the tubular bag material; and wherein said base and member provide gas passages that communicate with the socket so to receive a gas from said spigot and deliver the gas to said product passage.

2. The former of claim 1, wherein said gas passages extend to said member so as to deliver the gas to said product passage.

3. The former of claim 2, further including a backing member extending downwardly from the base, and wherein said gas passages extend through said backing member to deliver said gas to the interior of the tubular bag material.

4. The former of claim 3, wherein the former is configured to engage a packaging machine having a pair of upwardly extending locating spigots, each spigot providing a gas outlet, and wherein said socket is a first socket, and said base has a second socket, with the sockets being positioned to each respectively receive a respective one of the spigots so as to receive gas therefrom, with the gas passages communicating with each socket.

5. The former of claim 1, wherein the former is configured to engage a packaging machine having a pair of upwardly extending locating spigots, each spigot providing a gas outlet, and wherein said socket is a first socket, and said base has a second socket, with the sockets being positioned to each respectively receive a respective one of the spigots so as to receive gas therefrom, with the gas passages communicating with each socket.

6. A packaging machine including a mounting upon which a packaging former is to rest so as to be supported thereby, and wherein said mounting includes an upwardly extending spigot to be received by the former to locate the former with respect to the machine, said spigot including a gas passage to which a gas is delivered to the former, and a moveable valve member operatively associated with the passage so as to be moveable between a first position closing said passage, and a second position permitting gas to pass through said passage, said moveable valve member being urged to the first position and moved to the second position upon engagement with the former.

7. A packaging machine former to engage an upwardly projecting locating spigot of a packaging machine, the spigot including a gas outlet, the former including:

a base having a socket to receive the spigot so that the former is located thereby with respect to the machine;

a former member over which strip bag material passes to be configured into tubular bag material, the former member providing a generally vertically oriented product passage into which product is deposited for delivery into the tubular bag material;

a backing member extending downwardly from the base, and wherein said base, former member and backing member provide gas passages that communicate with the socket so to receive a gas from said spigot and deliver the gas to said product passage, with said passages extending through said backing member to deliver said gas to the interior of the tubular bag material.

8. The former of claim 7, wherein the former is configured to engage a packaging machine having a pair of upwardly extending locating spigots, each spigot providing a gas outlet, and wherein said socket is a first socket, and said base has a second socket, with the sockets being positioned to each respectively receive a respective one of the spigots so as to receive gas therefrom, with the gas passages communicating with each socket.

* * * * *